United States Patent [19]

Bergkvist

[11] Patent Number: 4,782,771

[45] Date of Patent: Nov. 8, 1988

[54] METHOD OF REDUCING THE CONTENT OF NITROGEN OXIDES IN MULTIPLE BED COMPOSITION BOILERS

[75] Inventor: Jörgen Bergkvist, Finspang, Sweden

[73] Assignee: Asea Stal AB, Linköping, Sweden

[21] Appl. No.: 70,944

[22] Filed: Jul. 8, 1987

[30] Foreign Application Priority Data

Jul. 8, 1986 [SE] Sweden ..... 8603035

[51] Int. Cl.[4] ..... F23J 11/00; F23J 15/00

[52] U.S. Cl. ..... 110/345; 110/342; 423/235

[58] Field of Search ..... 110/342, 343, 344, 345; 122/4 D; 423/235

[56] References Cited

U.S. PATENT DOCUMENTS 4,181,705 1/1980 Gumerman .
4,303,023 12/1981 Perkins et al. ..... 110/345 X
4,519,324 5/1985 Toth ..... 110/343 X
4,616,576 10/1986 Engström et al. ..... 110/345
4,648,331 3/1987 Thelen ..... 110/343 X

FOREIGN PATENT DOCUMENTS 3441141 1/1980 Fed. Rep. of Germany .
8500898-5 3/1984 Sweden .
442242 12/1985 Sweden .

*Primary Examiner*—Edward G. Favors
*Attorney, Agent, or Firm*—Merchant, Gould, Smith, Edell, Welter & Schmidt

[57] ABSTRACT

Method of supplying ammonia gas to boilers having at least two fluidized beds one above the other for reducing the content of nitrogen oxides in the flue gas wherein the ammonia gas is intermixed with secondary air or tertiary air before said air intermixed with flue gas from the lower fluidized bed is supplied to the upper fluidized bed or the upper fluidized beds, respectively, for fluidization equally distributed over the area of the bed or beds, respectively.

5 Claims, 1 Drawing Sheet

METHOD OF REDUCING THE CONTENT OF NITROGEN OXIDES IN MULTIPLE BED COMPOSITION BOILERS

The invention relates to a method of reducing the content of nitrogen oxides (NOX reduction) in multiple bed combustion boilers (MBC boilers) and more particularly to a method of supplying ammonia gas to boilers having at least two fluidized beds, one located above the other, for reducing the content of nitrogen oxides in the flue gas.

In the prior art application of such NOX reduction, the ammonia gas is added to the flue gas escaping from the upper fluidized bed or the uppermost fluidized bed, respectively. The purpose of the invention is to improve further the NOX reduction that can be obtained by supplying ammonia gas, viz. by supplying the ammonia gas in a novel manner.

For said purpose the invention provides a method of supplying ammonia gas to boilers having at least two fluidized beds, one located above the other, for reducing the content of nitrogen oxides in the flue gas, comprising the steps of intermixing the ammonia gas with air, and supplying said mixture to a plurality of individual flue gas streams flowing from the lower fluidized bed from below into the upper fluidized bed, distributed over the area of the upper bed, said upper bed being fluidized by means of the gas streams consisting of flue gas and air having ammonia gas intermixed therewith.

The invention also provides a method of supplying ammonia gas to boilers having at least two fluidized beds located one above the other, for reducing the content of nitrogen oxides in the flue gas, comprising the steps of intermixing ammonia gas with at least one of secondary air and tertiary air, and supplying said mixture to a plurality of individual flue gas streams flowing from a lower fluidized bed from below into an upper fluidized bed, distributed over the area of the upper bed, said upper bed being fluidized by means of the gas streams consisting of flue gas and said air having ammonia gas intermixed therewith.

Figure 1:
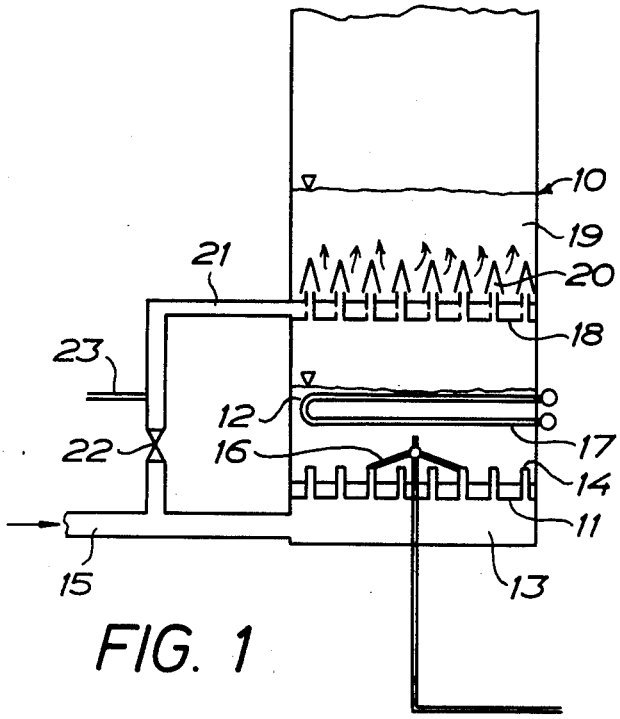
Figure 2:
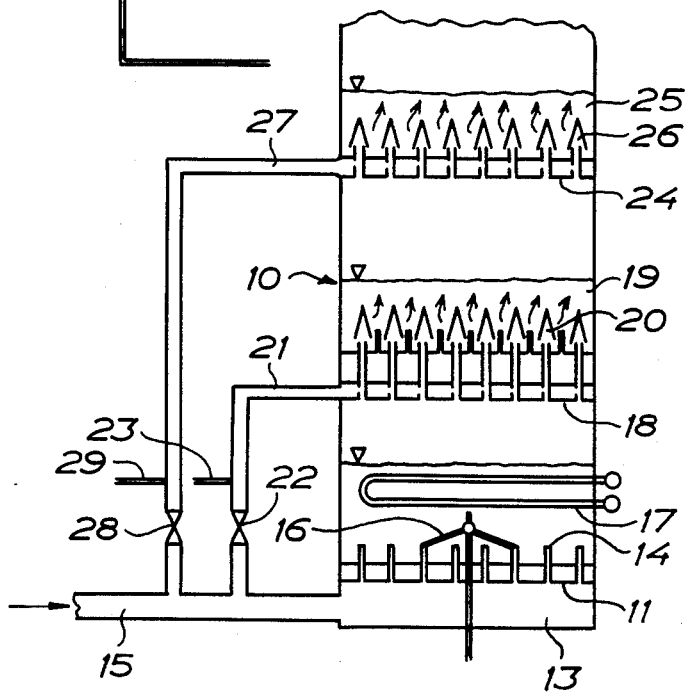

In order to explain the invention in more detail reference is made to the accompanying drawing in which FIG. 1 is a diagrammatic vertical sectional view of a multiple bed combustion boiler having two fluidized beds, and FIG. 2 is a corresponding view of a multiple bed combustion boiler having three fluidized beds.

The multiple bed combustion boiler (MBC boiler) shown in FIG. 1, comprises a boiler enclosure 10 having in a manner known per se cooled surfaces although such surfaces are not shown in detail in the drawing. At the lower end of the boiler there is provided a horizontal bed bottom 11 supporting the bed material of a lower fluidized bed 12 comprising an inert particulate material e.g. sand, a fuel and possibly also ashes and a sulphur adsorbent (e.g. limestone or dolomite). Below the bed bottom, a plenum 13 is provided which communicates with the fluidized bed through nozzles 14 uniformly distributed over the horizontal area of the bed bottom. A conduit 15 for the supply of pressurized air is connected with the plenum. Moreover, means 16 are provided for supplying fuel and possibly also ashes in case the boiler operates with ash feedback, to the upper surface of the bed bottom. A tube set 17 is provided above the bed bottom.

When pressurized air is supplied, said air being uniformly distributed over the total horizontal area of the bed bottom through the plenum and the nozzles, the bed material will be fluidized providing a fluidized bed the height of which is adapted to the actual power need in dependence on the existing air flow. When the fuel has been ignited, it will be combusted in the fluidized bed enclosing more or less the tube set for the generation of hot water or steam therein.

Above the freeboard of the lower fluidized bed an upper horizontal bed bottom 18 is provided supporting the bed material of an upper fluidized bed 19. In the upper bed bottom, nozzles of pyramid type are provided uniformly distributed over the horizontal area of the upper bed bottom, for the supply of the flue gas from the lower fluidized bed as a plurality of individual flue gas streams to the upper fluidized bed which is fluidized by the flue gas. The material of the upper fluidized bed can comprise material of the same type as that included in the lower fluidized bed, the fuel, however, comprising fuel particles entrained in the flue gas supplied, which shall be combusted in the upper fluidized bed thus forming an afterburning bed. The combustion gas in the upper fluidized bed comprises a mixture of the flue gas from the lower fluidized bed and secondary air which is supplied through a conduit 21 having a control valve, to the nozzles 20 from the conduit 15. The flue gas from the upper fluidized bed escapes via convection tube sets to a chimney in a manner not shown in detail here.

For further reduction of nitrogen oxides in the boiler by applying the method of the invention ammonia gas is intermixed with the secondary air at 23 before the secondary air is supplied to the several individual flue gas streams from the lower fluidized bed, penetrating into the upper fluidized bed. The ammonia gas will be well intermixed with the secondary air and will be supplied to the upper fluidized bed together with the combustion gas uniformly distributed over the total horizontal area of the upper fluidized bed by means of the nozzles 20. By this arrangement there is achieved optimum admixture and distribution of the ammonia gas in the flue gas leaving the upper fluidized bed, which in turn means an optimum reduction of nitrogen oxides superior to that obtained in the conventional supply of ammonia gas directly to the flue gas escaping from the upper fluidized bed.

In the embodiment of FIG. 2, a third horizontal bed bottom 24 is provided supporting the material of a third fluidized bed 25. This bed bottom is identical with the bed bottom 18 in FIG. 1 and has nozzles 26 of pyramid type arranged in the same manner as the nozzles of the bed bottom 18. The material of the fluidized bed 25 can be identical with that of the fluidized bed 19. Air, in this case tertiary air, is supplied through a conduit 27 which is connected over a control valve 28 with the air conduit 15. Ammonia gas is intermixed also with the tertiary air at 29 so as to be supplied with the combustion gas of the uppermost fluidized bed, said combustion gas consisting of the tertiary air supplied and flue gas from the intermediate fluidized bed. The tertiary air intermixed with the ammonia gas is supplied to the several individual streams of flue gas from the intermediate fluidized bed such that the ammonia gas will be uniformly distributed in the flue gas escaping from the uppermost fluidized bed. In this embodiment, the ammonia gas supplied can be proportioned between the intermediate fluidized bed and the uppermost fluidized bed considering a suitable secondary and tertiary air flow, respectively, and a suitable flue gas temperature.

The admixture of ammonia gas to the secondary air and the tertiary air, respectively, would be still more effective if the air is preheated.

Maximum reduction oxides will be obtained in the temperature range about 950° C. The flue gas temperature downstream of the lowermost fluidized bed can be influenced by crashing the fuel more or less, by varying the ash feedback when such feedback is applied, and by affecting the ratio between primary air and secondary air, and—when applicable—the tertiary air.

I claim:

1. Method of supplying ammonia gas to boilers having at least two fluidized beds located one above the other, for reducing the content of nitrogen oxides in the flue gas, comprising the steps of intermixing ammonia gas with at least one of secondary air and tertiary air, dividing the flue gases into individual streams and supplying said mixture to each of said individual streams from below a lower fluidized bed and through an upper fluidized bed, distributing the streams over the area of the upper bed, said upper bed being fluidized by means of the gas streams consisting of flue gas and said air having ammonia gas intermixed therewith.

2. Method as in claim 1 wherein the admixture of ammonia gas to said air is adapted to the prevailing air flow.

3. Method as in claim 1 wherein the admixture of ammonia gas to said air is adapted to the prevailing flue gas temperature.

4. Method as in claim 1 wherein the amount of admixed ammonia gas is adapted to the prevailing content of nitrogen oxides, the prevailing air flow, and the prevailing flue gas temperature.

5. Method as in claim 1 wherein the amount of admixed ammonia gas is limited by the residual amount of ammonia in the escaping flue gas.

* * * * *